US009863086B2

(12) United States Patent
Zhu et al.

(10) Patent No.: US 9,863,086 B2
(45) Date of Patent: Jan. 9, 2018

(54) HEAT PUMP MOUNTING BOX AND HEAT PUMP DRIER OR HEAT PUMP WASHER-DRIER

(71) Applicant: Wuxi Little Swan Co., Ltd., Wuxi (CN)

(72) Inventors: Chunyu Zhu, Wuxi (CN); Yulai Miao, Wuxi (CN); Wei Qian, Wuxi (CN)

(73) Assignee: Wuxi Little Swan Co., Ltd., Wuxi (CN)

( * ) Notice: Subject to any disclaimer, the term of this patent is extended or adjusted under 35 U.S.C. 154(b) by 0 days.

(21) Appl. No.: 15/349,328

(22) Filed: Nov. 11, 2016

(65) Prior Publication Data

US 2017/0342641 A1 Nov. 30, 2017

(30) Foreign Application Priority Data

May 31, 2016 (CN) ..... 2016 1 0378796
May 31, 2016 (CN) ..... 2016 2 0519282 U

(51) Int. Cl.
*D06F 58/04* (2006.01)
*D06F 58/20* (2006.01)
*D06F 39/04* (2006.01)

(52) U.S. Cl.
CPC ..... *D06F 58/206* (2013.01); *D06F 39/04* (2013.01)

(58) Field of Classification Search
CPC ..... D06F 58/206; D06F 58/04
USPC ..... 34/86, 595–610; 68/19, 20
See application file for complete search history.

(56) References Cited

U.S. PATENT DOCUMENTS 2,742,708 A * 4/1956 McCormick ..... D06F 58/02 34/60
5,555,640 A * 9/1996 Ou ..... A47L 19/00 211/133.6
6,018,885 A * 2/2000 Hill ..... D06F 58/10 34/202
7,121,018 B2 * 10/2006 Lee ..... D06F 58/24 34/595

(Continued)

FOREIGN PATENT DOCUMENTS

BR PI 1103958-2 A2 * 1/2013
DE 10 2008 020 671 A1 * 4/2008

(Continued)

*Primary Examiner* — Stephen M Gravini
(74) *Attorney, Agent, or Firm* — Lathrop Gage LLP

(57) ABSTRACT

A heat pump mounting box for a heat pump drier or washer-drier, and a heat pump drier or washer-drier having the same are provided. The heat pump mounting box includes a base provided with an air suction port, a two-device mounting chamber, a fan mounting chamber, and a fan air inlet for communicating the two-device mounting chamber and the fan mounting chamber; an air passage guide plate mounted to the base and defining, together with the base, an air guide passage that has a drying air inlet in communication with the air suction port and a drying air outlet in communication with the two-device mounting chamber; an air guide wall disposed in the two-device mounting chamber and opposite the drying air outlet; and a cover plate mounted over the base and at least covering the two-device mounting chamber. The heat pump mounting box according to the present invention has a high utilization rate of the drying air and a good drying performance.

22 Claims, 3 Drawing Sheets

(56) References Cited

U.S. PATENT DOCUMENTS

| | | | | |
|---|---|---|---|---|
| 7,204,039 | B2 * | 4/2007 | Cho | D06F 25/00 34/596 |
| 7,665,226 | B2 * | 2/2010 | Tsuruta | A23B 4/015 219/688 |
| 7,984,568 | B2 * | 7/2011 | Dittmer | D06F 58/24 165/186 |
| 8,132,339 | B2 * | 3/2012 | Moon | D06F 58/20 34/601 |
| 8,181,359 | B2 * | 5/2012 | Bae | D06F 58/203 134/22.12 |
| 8,266,824 | B2 * | 9/2012 | Steiner | D06F 58/206 34/595 |
| 8,327,558 | B2 * | 12/2012 | Hu | D06F 58/14 34/210 |
| 8,627,581 | B2 * | 1/2014 | Brown | D06F 58/02 34/603 |
| 8,707,581 | B2 * | 4/2014 | Quaroni | D06F 39/12 34/604 |
| 9,097,462 | B2 * | 8/2015 | Lorenc | D06F 58/206 |
| 9,243,844 | B2 * | 1/2016 | Yu | F26B 21/004 |
| 9,534,843 | B2 * | 1/2017 | Palazzin | F26B 21/004 |
| 9,617,680 | B2 * | 4/2017 | Kitayama | D06F 58/24 |
| 9,731,865 | B2 * | 8/2017 | Heβ | B65D 25/14 |
| 2008/0289209 | A1 * | 11/2008 | Han | D06F 58/206 34/74 |
| 2010/0011608 | A1 * | 1/2010 | Grunert | D06F 58/206 34/85 |
| 2016/0376744 | A1 * | 12/2016 | LV | F28F 9/001 34/73 |
| 2017/0191213 | A1 * | 7/2017 | Kim | D06F 37/22 |
| 2017/0268159 | A1 * | 9/2017 | Brown | D06F 58/28 |

FOREIGN PATENT DOCUMENTS

| | | | |
|---|---|---|---|
| EP | 1 659 208 | A2 * | 5/2006 |
| EP | 2 423 378 | A1 * | 2/2012 |
| EP | 2 423 378 | B1 * | 4/2013 |

* cited by examiner

HEAT PUMP MOUNTING BOX AND HEAT PUMP DRIER OR HEAT PUMP WASHER-DRIER

CROSS-REFERENCE TO RELATED APPLICATIONS

This application claims priority to and benefits of Chinese Patent Application Serial No. 201610378796.3 and Chinese Patent Application Serial No. 201620519282.0, each of which was filed with the State Intellectual Property Office of P. R. China on May 31, 2016. The entire contents of each of the above-mentioned applications are incorporated herein by reference.

FIELD

The present invention relates to a field of washing equipment, and more particularly to a heat pump mounting box for a heat pump drier or washer-drier, and a heat pump drier or washer-drier having the same.

BACKGROUND

For a heat pump drier or washer-drier in the related art, due to obstruction of fins of an evaporator and a condenser, only drying air flowing through a center of a two-device mounting chamber in a transverse direction thereof rather than flowing adjacent to two longitudinal side walls thereof can enter the fan air inlet directly, so that drying air utilization rate is low and clothes drying performance is poor.

SUMMARY

The present invention aims to solve at least one of the problems existing in the related art. Thus, embodiments of the present invention provide a heat pump mounting box for a heat pump drier or washer-drier that has advantages of high utilization rate of drying air and good drying performance.

Embodiments of the present invention further provide a heat pump drier or washer-drier having the heat pump mounting box.

According to embodiments of a first aspect of the present invention, the heat pump mounting box includes a base provided with an air suction port, a two-device mounting chamber, a fan mounting chamber, and a fan air inlet for communicating the two-device mounting chamber and the fan mounting chamber; an air passage guide plate mounted to the base and defining, together with the base, an air guide passage that has a drying air inlet in communication with the air suction port and a drying air outlet in communication with the two-device mounting chamber; an air guide wall configured to guide air in the two-device mounting chamber into the fan air inlet, and disposed in the two-device mounting chamber and opposite the drying air outlet; and a cover plate mounted over the base and at least covering the two-device mounting chamber.

For the heat pump mounting box according to the embodiments of the present invention, the air guide wall is disposed in the two-device mounting chamber and opposite the drying air outlet, such that all the drying air in the two-device mounting chamber can enter the fan air inlet directly, so as to improve the utilization rate of the drying air and the clothes drying performance.

Moreover, the heat pump mounting box according to the present invention has the following additional technical features.

According to some embodiments of the present invention, the air guide wall includes a first air guide sub-wall and a second air guide sub-wall arranged along a transverse direction of the two-device mounting chamber.

Further, each of the first air guide sub-wall and the second air guide sub-wall includes an outer arc segment, an inner arc segment, and a straight segment connected between the outer arc segment and the inner arc segment; and the outer arc segment and the inner arc segment both protrude in a direction away from the drying air outlet.

Alternatively, the outer arc segment of the first air guide sub-wall is connected with a first longitudinal side wall of the two-device mounting chamber, the outer arc segment of the second air guide sub-wall is connected with a second longitudinal side wall of the two-device mounting chamber, and the inner arc segment of the first air guide sub-wall is connected with that of the second air guide sub-wall.

Preferably, the connection between the inner arc segment of the first air guide sub-wall and that of the second air guide sub-wall is at a center of the two-device mounting chamber in the transverse direction thereof.

In some embodiments of the present invention, the outer arc segment has a smaller radius than the inner arc segment.

In some specific embodiments of the present invention, the outer arc segment has a greater length than the inner arc segment.

According to some embodiments of the present invention, the two-device mounting chamber includes an evaporator mounting section and a condenser mounting section communicated with each other; the drying air outlet is in communication with the evaporator mounting section and the fan air inlet is in communication with the condenser mounting section; and the air guide wall is disposed in the condenser mounting section.

Further, the drying air outlet is provided in a transverse side wall of the two-device mounting chamber, the fan mounting chamber is located below the two-device mounting chamber, and the fan air inlet is provided in a bottom wall of the condenser mounting section.

Preferably, the fan air inlet is configured as a circular opening, and disposed at the center of the two-device mounting chamber in the transverse direction thereof and adjacent to the air guide wall.

According to some embodiments of the present invention, the air guide wall is connected to the base and integrally formed with the base.

According to embodiments of a second aspect of the present invention, the heat pump drier or washer-drier includes the heat pump mounting box according to the embodiments of the first aspect of the present invention.

The heat pump drier or washer-drier according to the present invention employs the heat pump mounting box mentioned above, so as to enjoy the high utilization rate of drying air and good drying performance, and facilitate componentization and modularization of production and installation.

Additional aspects and advantages of embodiments of present invention will be given in part in the following descriptions, become apparent in part from the following descriptions, or be learned from the practice of the embodiments of the present invention.

Figure 1:
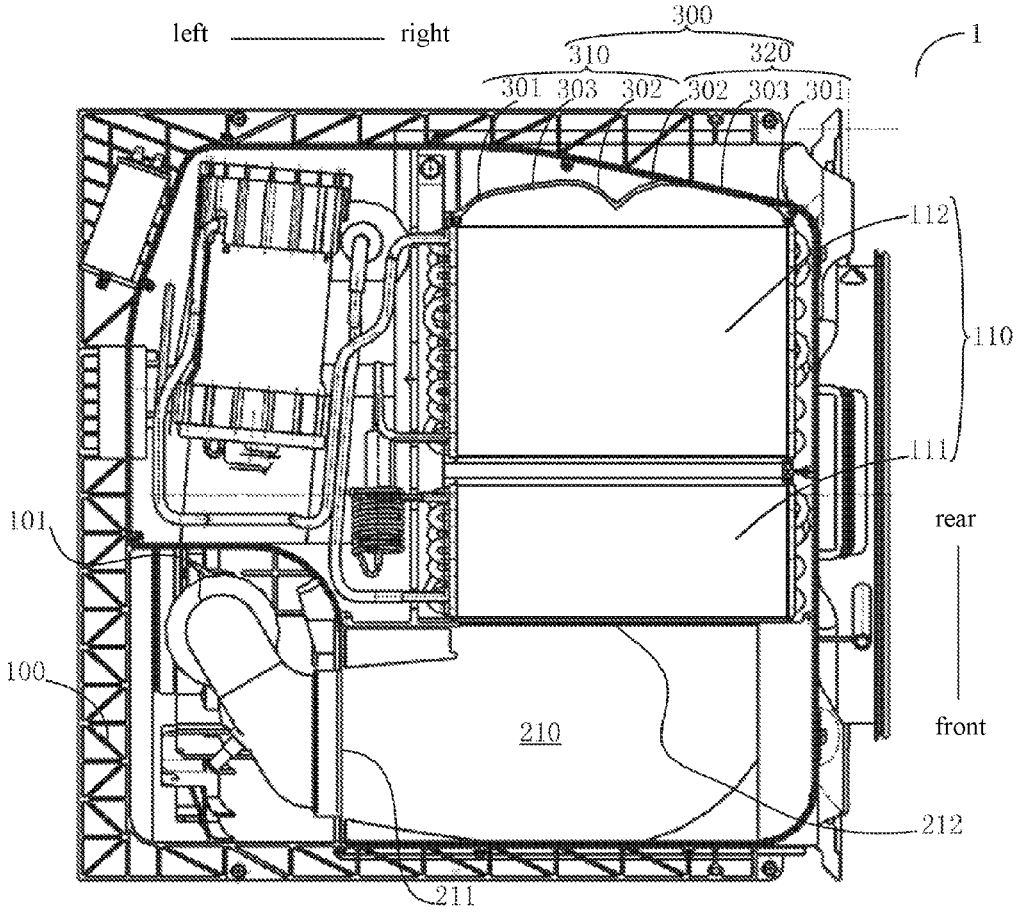
FIG. 1 is a schematic view of a heat pump mounting box for a heat pump drier or washer-drier according to an embodiment of the present invention.

REFERENCE NUMERALS heat pump mounting box 1,
base 100,
air suction port 101, fan air inlet 102, two-device mounting chamber 110, evaporator mounting section 111, condenser mounting section 112,
air guide passage 210, drying air inlet 211, drying air outlet 212,
air guide wall 300, outer arc segment 301, inner arc segment 302, straight segment 303, first air guide sub-wall 310, second air guide sub-wall 320,
cover plate 400.

DETAILED DESCRIPTION

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

In the following, a heat pump mounting box 1 for a heat pump drier or washer-drier according to embodiments of a first aspect of the present invention will be described with reference to FIGS. 1 to 3. The heat pump mounting box 1 is suitable for an integrated pre-installed heat pump drying system, and may be disposed at the top of the heat pump drier or washer-drier, which is conductive to implementing componentized and modularized production and installation and has the advantages of high utilization rate of drying air and good drying performance.

Figure 2:
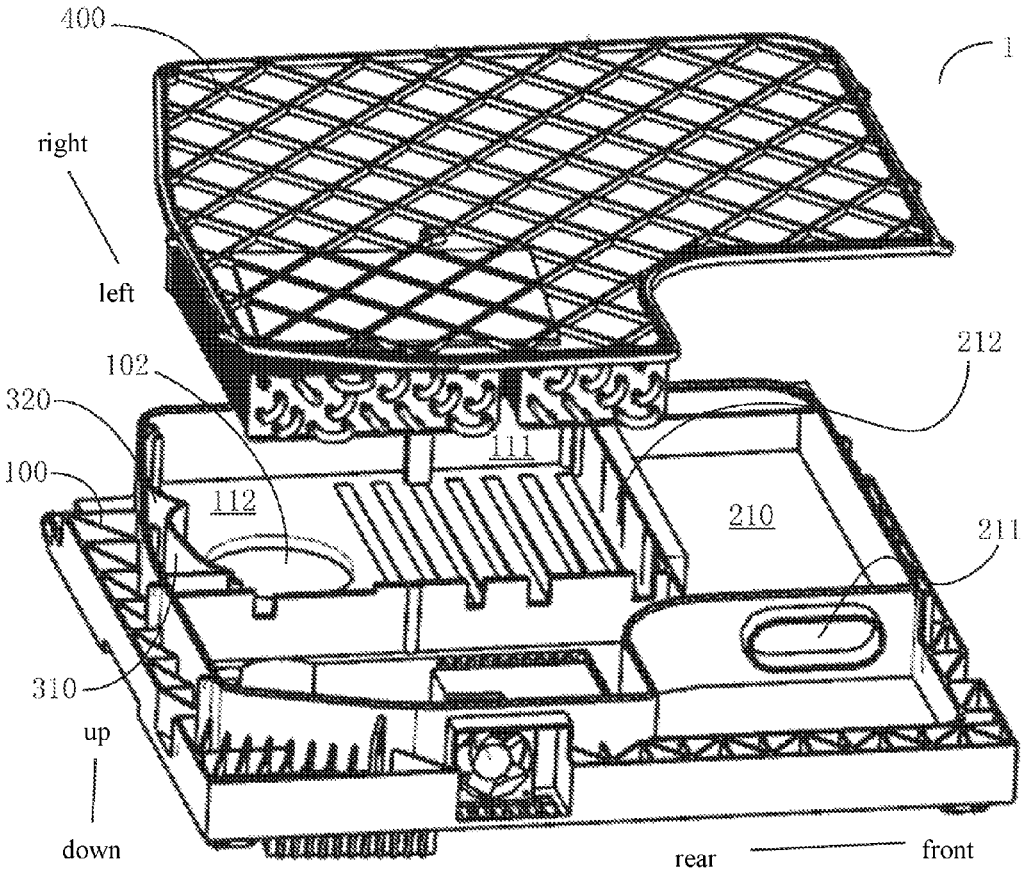
FIG. 2 is an exploded view of the heat pump mounting box according to the embodiment of the present invention.
Figure 3:
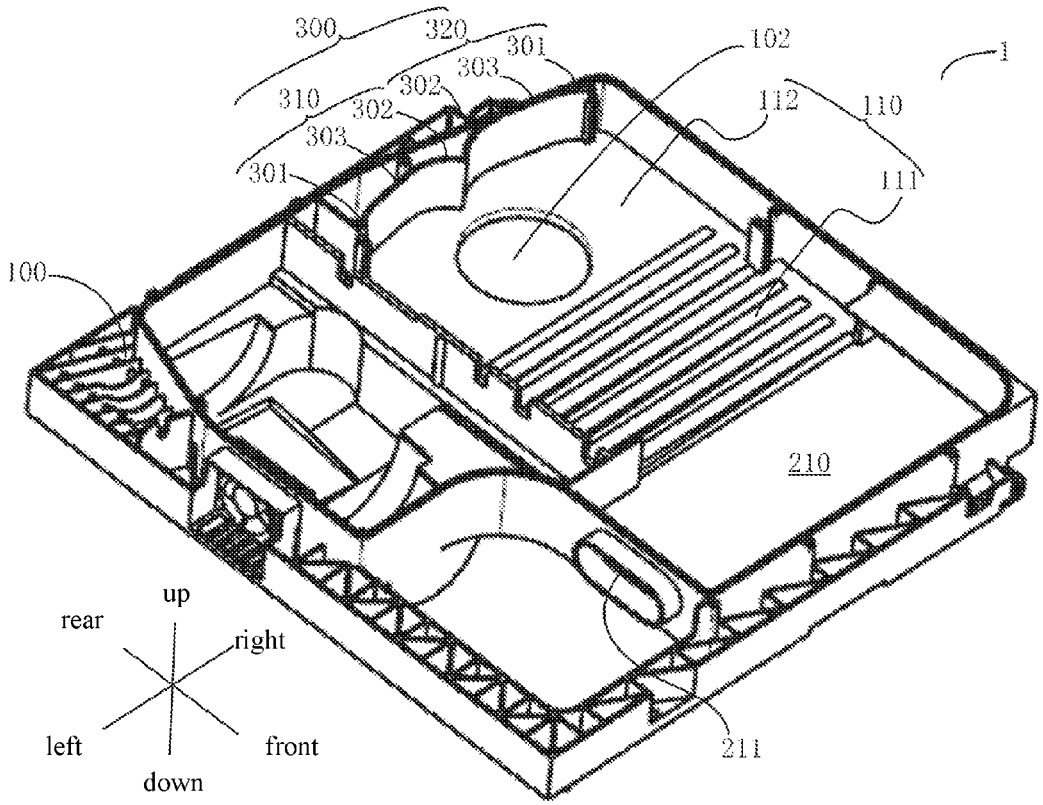
FIG. 3 is a schematic view of the heat pump mounting box according to the embodiment of the present invention.

As shown in FIGS. 1 to 3, the heat pump mounting box 1 according to the embodiments of the present invention includes a base 100, an air passage guide plate (not shown), an air guide wall 300 and a cover plate 400.

Specifically, the base 100 is provided with an air suction port 101, a two-device mounting chamber 110, a fan mounting chamber (not shown), and a fan air inlet 102 for communicating the two-device mounting chamber 110 and the fan mounting chamber. The air passage guide plate is mounted to the base 100 and defines, together with the base 100, an air guide passage 210 that has a drying air inlet 211 in communication with the air suction port 101 and a drying air outlet 212 in communication with the two-device mounting chamber 110. The air guide wall 300 is disposed in the two-device mounting chamber 110 and opposite the drying air outlet 212, and configured to guide air in the two-device mounting chamber 110 into the fan air inlet 102. The cover plate 400 is mounted over the base 100 and at least covers the two-device mounting chamber 110.

The term "two-device" in the two-device mounting chamber 110 refers to an evaporator and a condenser that constitute the heat pump drying system, and the evaporator and the condenser are mounted within the two-device mounting chamber 110 separately. The fan mounting chamber is configured to mount a fan for constituting the heat pump drying system. It can be understood that the heat pump drying system may further include a throttling device, a compressor, a sealing member, a damping member and a filtering device. It can also be understood that the cover plate 400 at least covers the two-device mounting chamber 110, including but not limited to the following two cases that the cover plate 400 only covers the two-device mounting chamber 110, and the cover plate 400 covers the two-device mounting chamber 110 and the air passage guide plate.

A drying air circulation process in the heat pump mounting box 1 according to the embodiments of the present invention will be illustrated below with reference to the drawings.

The drying air enters the air guide passage 210 via the drying air inlet 211 from the air suction port 101, and then enters the two-device mounting chamber 110 via the drying air outlet 212. The fan draws the drying air in the two-device mounting chamber 110 into the fan mounting chamber through the fan air inlet 102, and fan blades blow the drying air into a washing drum of the heat pump drier or washer-drier to dry clothes in the washing drum. In the above process, the drying air adjacent to two longitudinal side walls of the two-device mounting chamber 110 may directly turn back to the fan air inlet 102 after running into the air guide wall 300, such that the drying air condensed by the evaporator and heated by the condenser may be directly guided into the fan mounting chamber, thereby improving the utilization rate of the drying air and the clothes drying performance.

For the heat pump mounting box 1 according to the embodiments of the present invention, the air guide wall 300 is disposed in the two-device mounting chamber 110 and opposite the drying air outlet 212, such that all the drying air in the two-device mounting chamber 110 can enter the fan air inlet 102 directly, so as to improve the utilization rate of the drying air and the clothes drying performance.

It shall be noted that in the description concerning directions of the present invention, a longitudinal direction of the two-device mounting chamber 110 is consistent with a front-and-rear direction in the drawings, and a transverse direction thereof is consistent with a left-and-right direction in the drawings.

In some embodiments of the present invention, as shown in FIGS. 1 to 3, the air guide wall 300 may include a first air guide sub-wall 310 and a second air guide sub-wall 320 arranged along the transverse direction of the two-device mounting chamber 110; a central axis of the drying air outlet 212 extends along the front-and-rear direction. Consequently, the drying air flows front to rear in the two-device mounting chamber 110, and the drying air adjacent to left and right side walls of the two-device mounting chamber 110 directly enters the fan air inlet 102 after running into the first air guide sub-wall 310 and the second air guide sub-wall 320. Herein, the first air guide sub-wall 310 and the second air guide sub-wall 320 may be symmetrical with respect to a longitudinally extending central axis of the two-device mounting chamber 110, so as to guide the drying air into the center of the fan air inlet 102 conveniently, and facilitate the machining and modeling. Preferably, the air guide wall 300 is connected to the base 100 and integrally formed with the base 100, so as to further facilitate the machining and modeling.

Further, as shown in FIGS. 1 to 3, each of the first air guide sub-wall 310 and the second air guide sub-wall 320 includes an outer arc segment 301, an inner arc segment 302, and a straight segment 303 connected between the outer arc segment and the inner arc segment; and the outer arc segment 301 and the inner arc segment 302 both protrude in a direction away from the drying air outlet 212 (i.e. a rear side in the drawings). In such a way, the drying air flowing along the two longitudinal side walls of the two-device mounting chamber 110 may enter the fan air inlet 102 successfully under the guidance of the outer arc segment 301, the inner arc segment 302, and the straight segment 303, so as to further improve the utilization rate of the drying air. Herein, the outer arc segment 301 of each of the first air guide sub-wall 310 and the second air guide sub-wall 320 is an arc segment adjacent to the longitudinal side wall of the two-device mounting chamber 110, and the inner arc segment 302 thereof is an arc segment adjacent to a transverse center of the two-device mounting chamber 110.

Alternatively, as shown in FIGS. 1 to 3, the outer arc segment 301 of the first air guide sub-wall 310 is connected with a first longitudinal side wall of the two-device mounting chamber 110 (e.g. a left side wall of the two-device mounting chamber 110), the outer arc segment 301 of the second air guide sub-wall 320 is connected with a second longitudinal side wall of the two-device mounting chamber 110 (e.g. a right side wall of the two-device mounting chamber 110), and the inner arc segment 302 of the first air guide sub-wall 310 is connected with that of the second air guide sub-wall 320. Thus, the drying air is guided to the inner arc segment 302 of the first air guide sub-wall 310 and that of the second air guide sub-wall 320, to make it convenient to guide all the drying air coming from the two longitudinal side walls of the two-device mounting chamber 110 into the fan air inlet 102.

Preferably, as shown in FIG. 1, the connection between the inner arc segment 302 of the first air guide sub-wall 310 and that of the second air guide sub-wall 320 is at a center of the two-device mounting chamber 110 in the transverse direction thereof, such that it is convenient to guide all the drying air coming from the two longitudinal side walls of the two-device mounting chamber 110 to the center of the two-device mounting chamber 110.

In the embodiment shown in FIGS. 1 and 3, the outer arc segment 301 has a smaller radius than the inner arc segment 302, so as to directly pull the drying air back to the fan air inlet 102. Advantageously, the outer arc segment 301 has a greater length than the inner arc segment 302, such that the drying air may enter the fan air inlet 102 fully and smoothly.

In some embodiments of the present invention, as shown in FIGS. 1 to 3, the two-device mounting chamber 110 includes an evaporator mounting section 111 and a condenser mounting section 112 communicated with each other; the drying air outlet 212 is in communication with the evaporator mounting section 111 and the fan air inlet 102 is in communication with the condenser mounting section 112; and the air guide wall 300 is disposed in the condenser mounting section 112. Thus, the air guide wall 300 is located at a rear end of the drying air flow direction, and the drying air may flow through the evaporator to be condensed, then through the condenser to be heated, and finally enter the fan mounting chamber via the fan air inlet 102 directly owing to the obstruction of the guide air wall 300, so as to realize the drying of clothes.

Further, as shown in FIGS. 1 and 2, the drying air outlet 212 is provided in a transverse side wall of the two-device mounting chamber 110, the fan mounting chamber is located below the two-device mounting chamber 110, and the fan air inlet 102 is provided in a bottom wall of the condenser mounting section 112, such that the drying air may exchange heat with the evaporator and the condenser sequentially, flow downwards to enter the fan mounting chamber, and then enter the washing drum successfully.

Preferably, as shown in FIGS. 2 and 3, the fan air inlet 102 is configured as a circular opening, and disposed at the center of the two-device mounting chamber 110 in the transverse direction thereof and adjacent to the air guide wall 300, so as to facilitate the guidance of all the drying air to the center of the fan air inlet 102 and further improve the utilization rate of the drying air.

The heat pump mounting box 1 according to a specific embodiment of the present invention will be described in detail with reference to the drawings. It should be appreciated that the following description is only explanatory and shall not be construed to limit the present invention.

As shown in FIGS. 1 to 3, the heat pump mounting box 1 according to the embodiment of the present invention includes the base 100, the air passage guide plate, the air guide wall 300 and the cover plate 400.

Specifically, the base 100 is provided with the air suction port 101, the two-device mounting chamber 110, the fan mounting chamber, and the fan air inlet 102. The two-device mounting chamber 110 includes the evaporator mounting section 111 and the condenser mounting section 112 communicated with each other, and the fan mounting chamber is located below the two-device mounting chamber 110. The fan air inlet 102 is provided in the bottom wall of the condenser mounting section 112 and located at a center of the condenser mounting section 112 in the left-and-right direction; the fan air inlet 102 is configured as a circular opening and is in communication with the condenser mounting section 112 and the fan mounting chamber. The air passage guide plate is mounted on the base 100 and defines, together with the base, the air guide passage 210 that has the drying air inlet 211 in communication with the air suction port 101 and the drying air outlet 212 which is disposed in a front side wall of the evaporator mounting section 111 and in communication with the evaporator mounting section 111, and has a central axis extending along the front-and-rear direction. The cover plate 400 is mounted over the base 100 and at least covers the two-device mounting chamber 110 and the air passage guide plate.

The air guide wall 300 is integrally formed with the base 100 and located at a rear end of the condenser mounting section 112; the air guide wall 300 is adjacent to the fan air inlet 102, and includes the first air guide sub-wall 310 and the second air guide sub-wall 320 arranged along the left-and-right direction and arranged symmetrically with respect to the central axis of the two-device mounting chamber 110 extending in the front-and-rear direction. Each of the first air guide sub-wall 310 and the second air guide sub-wall 320 includes the outer arc segment 301, the inner arc segment 302, and the straight segment 303 connected between the outer arc segment and the inner arc segment; and the outer arc segment 301 and the inner arc segment 302 both protrude rearwards. The outer arc segment 301 of the first air guide sub-wall 310 is connected with a left side wall of the condenser mounting section 112, the outer arc segment 301 of the second air guide sub-wall 320 is connected with a right side wall of the condenser mounting section 112, and the inner arc segment 302 of the first air guide sub-wall 310 is connected with the inner arc segment 302 of the second air guide sub-wall 320. The connection between the inner arc segment 302 of the first air guide sub-wall 310 and that of the second air guide sub-wall 320 is at the center of the condenser mounting section 112 in the left-and-right direction. The outer arc segment 301 of each of the first air guide sub-wall 310 and the second air guide sub-wall 320 has a smaller radius and a greater length than the inner arc segment 302 thereof.

The drying air circulation process in the heat pump mounting box 1 according to the embodiment of the present invention will be illustrated below with reference to the drawings.

The drying air enters the air guide passage 210 via the drying air inlet 211 from the air suction port 101, then enters the evaporator mounting section 111 and the condenser mounting section 112 sequentially via the drying air outlet 212, and exchanges heat with the evaporator and the condenser sequentially. The fan draws the drying air in the condenser mounting section 112 into the fan mounting chamber through the fan air inlet 102, and the fan blades blow the drying air into the washing drum of the heat pump drier or washer-drier to dry clothes in the washing drum. In the above process, the drying air adjacent to the left side wall of the condenser mounting section 112 may directly turn back to the fan air inlet 102 sequentially along the outer arc segment 301, the inner arc segment 302 and the straight segment 303 of the first air guide sub-wall 310, after running into the first air guide sub-wall 310; the drying air adjacent to the right side wall of the condenser mounting section 112 may directly turn back to the fan air inlet 102 sequentially along the outer arc segment 301, the inner arc segment 302 and the straight segment 303 of the second air guide sub-wall 320, after running into the second air guide sub-wall 320. In such a way, the drying air heated by the evaporator and the condenser may be fully and directly guided into the fan mounting chamber, thereby improving the utilization rate of the drying air and the clothes drying performance.

For the heat pump mounting box 1 according to the embodiment of the present invention, by providing the first air guide sub-wall 310 and the second air guide sub-wall 320 at the rear end of the condenser mounting section 112 and opposite the drying air outlet 212, it can be guaranteed that all the drying air in the two-device mounting chamber 110 enters the fan air inlet 102 directly, so as to improve the utilization rate of the drying air and the clothes drying performance.

The heat pump drier or washer-drier according to embodiments of a second aspect of the present invention includes the heat pump mounting box 1 according to the embodiments of the first aspect of the present invention.

The heat pump drier or washer-drier according to the present invention employs the heat pump mounting box 1 described above, so as to enjoy the high utilization rate of drying air and good drying performance, and facilitate componentization and modularization of production and installation.

The other configurations and operations of the heat pump drier or washer-drier according to the embodiments of the present invention are known to those skilled in the art, which will not be elaborated herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Reference throughout this specification to "an embodiment," "some embodiments," "specific embodiments," "alternative embodiments," "an example," or "some examples" means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples. Those skilled in the art can integrate and combine different embodiments or examples and the features in different embodiments or examples in the specification.

Although embodiments of the present invention have been shown and illustrated, it shall be understood by those skilled in the art that various changes, modifications, alternatives and variants without departing from the principle and spirit of the present invention are acceptable. The scope of the present invention is defined by the claims or the like.

What is claimed is:

1. A heat pump mounting box for a heat pump drier or washer-drier, comprising:

a base provided with an air suction port, a two-device mounting chamber, a fan mounting chamber, and a fan air inlet for communicating the two-device mounting chamber and the fan mounting chamber;

an air passage guide plate mounted to the base and defining, together with the base, an air guide passage that has a drying air inlet in communication with the air suction port and a drying air outlet in communication with the two-device mounting chamber;

an air guide wall configured to guide air in the two-device mounting chamber into the fan air inlet, and disposed in the two-device mounting chamber and opposite the drying air outlet; and a cover plate mounted over the base and at least covering the two-device mounting chamber.

2. The heat pump mounting box according to claim 1, wherein the air guide wall comprises a first air guide sub-wall and a second air guide sub-wall arranged along a transverse direction of the two-device mounting chamber.

3. The heat pump mounting box according to claim 2, wherein each of the first air guide sub-wall and the second air guide sub-wall comprises an outer arc segment, an inner arc segment, and a straight segment connected between the outer arc segment and the inner arc segment; and the outer arc segment and the inner arc segment both protrude in a direction away from the drying air outlet.

4. The heat pump mounting box according to claim 3, wherein the outer arc segment of the first air guide sub-wall is connected with a first longitudinal side wall of the two-device mounting chamber, the outer arc segment of the second air guide sub-wall is connected with a second longitudinal side wall of the two-device mounting chamber, and the inner arc segment of the first air guide sub-wall is connected with that of the second air guide sub-wall.

5. The heat pump mounting box according to claim 4, wherein the connection between the inner arc segment of the first air guide sub-wall and that of the second air guide sub-wall is at a center of the two-device mounting chamber in the transverse direction thereof.

6. The heat pump mounting box according to claim 3, wherein the outer arc segment has a smaller radius than the inner arc segment.

7. The heat pump mounting box according to claim 3, wherein the outer arc segment has a greater length than the inner arc segment.

8. The heat pump mounting box according to claim 1, wherein the two-device mounting chamber comprises an evaporator mounting section and a condenser mounting section communicated with each other; the drying air outlet is in communication with the evaporator mounting section and the fan air inlet is in communication with the condenser mounting section; and the air guide wall is disposed in the condenser mounting section.

9. The heat pump mounting box according to claim 8, wherein the drying air outlet is provided in a transverse side wall of the two-device mounting chamber, the fan mounting chamber is located below the two-device mounting chamber, and the fan air inlet is provided in a bottom wall of the condenser mounting section.

10. The heat pump mounting box according to claim 9, wherein the fan air inlet is configured as a circular opening, and disposed at the center of the two-device mounting chamber in the transverse direction thereof and adjacent to the air guide wall.

11. The heat pump mounting box according to claim 1, wherein the air guide wall is connected to the base and integrally formed with the base.

12. A heat pump drier or washer-drier, comprising a heat pump mounting box, wherein the heat pump mounting box comprises:

a base provided with an air suction port, a two-device mounting chamber, a fan mounting chamber, and a fan air inlet for communicating the two-device mounting chamber and the fan mounting chamber;

an air passage guide plate mounted to the base and defining, together with the base, an air guide passage that has a drying air inlet in communication with the air suction port and a drying air outlet in communication with the two-device mounting chamber;

an air guide wall configured to guide air in the two-device mounting chamber into the fan air inlet, and disposed in the two-device mounting chamber and opposite the drying air outlet; and a cover plate mounted over the base and at least covering the two-device mounting chamber.

13. The heat pump drier or washer-drier according to claim 12, wherein the air guide wall comprises a first air guide sub-wall and a second air guide sub-wall arranged along a transverse direction of the two-device mounting chamber.

14. The heat pump drier or washer-drier according to claim 13, wherein each of the first air guide sub-wall and the second air guide sub-wall comprises an outer arc segment, an inner arc segment, and a straight segment connected between the outer arc segment and the inner arc segment; and the outer arc segment and the inner arc segment both protrude in a direction away from the drying air outlet.

15. The heat pump drier or washer-drier according to claim 14, wherein the outer arc segment of the first air guide sub-wall is connected with a first longitudinal side wall of the two-device mounting chamber, the outer arc segment of the second air guide sub-wall is connected with a second longitudinal side wall of the two-device mounting chamber, and the inner arc segment of the first air guide sub-wall is connected with that of the second air guide sub-wall.

16. The heat pump drier or washer-drier according to claim 15, wherein the connection between the inner arc segment of the first air guide sub-wall and that of the second air guide sub-wall is at a center of the two-device mounting chamber in the transverse direction thereof.

17. The heat pump drier or washer-drier according to claim 14, wherein the outer arc segment has a smaller radius than the inner arc segment.

18. The heat pump drier or washer-drier according to claim 14, wherein the outer arc segment has a greater length than the inner arc segment.

19. The heat pump drier or washer-drier according to claim 12, wherein the two-device mounting chamber comprises an evaporator mounting section and a condenser mounting section communicated with each other; the drying air outlet is in communication with the evaporator mounting section and the fan air inlet is in communication with the condenser mounting section; and the air guide wall is disposed in the condenser mounting section.

20. The heat pump drier or washer-drier according to claim 19, wherein the drying air outlet is provided in a transverse side wall of the two-device mounting chamber, the fan mounting chamber is located below the two-device mounting chamber, and the fan air inlet is provided in a bottom wall of the condenser mounting section.

21. The heat pump drier or washer-drier according to claim 20, wherein the fan air inlet is configured as a circular opening, and disposed at the center of the two-device mounting chamber in the transverse direction thereof and adjacent to the air guide wall.

22. The heat pump drier or washer-drier according to claim 12, wherein the air guide wall is connected to the base and integrally formed with the base.

* * * * *